US005189967A

United States Patent [19]

Schips et al.

[11] Patent Number: 5,189,967

[45] Date of Patent: Mar. 2, 1993

[54] APPARATUS FOR FEEDING LABELS TO A SEWING SITE OF AN INDUSTRIAL SEWING MACHINE

[76] Inventors: Helmut Schips, Klosterweidlistr. 1, CH-9000 St. Gallen; Jakob Wirth, Sulzbergstr. 20A, CH-9400 Rorschacherberg, both of Switzerland

[21] Appl. No.: 669,514

[22] Filed: Mar. 14, 1991

[30] Foreign Application Priority Data

Mar. 15, 1990 [EP] European Pat. Off. ..... 90104932

[51] Int. Cl.[5] ..... D05B 3/22

[52] U.S. Cl. ..... 112/113; 112/121.15

[58] Field of Search ..... 112/113, 114, 115, 262.3, 112/265.1; 271/18.3, 268, 84, 267

[56] References Cited

U.S. PATENT DOCUMENTS

| | | | |
|---|---|---|---|
| 2,548,692 | 4/1951 | Vollman et al. | 112/113 X |
| 2,560,186 | 7/1951 | Plopper | 112/113 |
| 3,742,878 | 7/1973 | Byrne et al. . | |
| 4,590,872 | 5/1986 | Bray | 112/113 X |
| 4,601,463 | 7/1986 | Goto et al. | 271/18.3 X |
| 4,645,193 | 2/1987 | Walton et al. | 271/18.3 |
| 4,674,739 | 6/1987 | Smith | 271/268 |
| 5,018,461 | 5/1991 | Kato et al. | 112/113 X |

FOREIGN PATENT DOCUMENTS

| | | | |
|---|---|---|---|
| 0172630 | 2/1986 | European Pat. Off. . | |
| 2118654 | 11/1972 | Fed. Rep. of Germany . | |
| 63-279874 | 11/1988 | Japan | 112/113 |
| 1-148294 | 6/1989 | Japan | 112/113 |
| 2067511 | 7/1981 | United Kingdom . | |

*Primary Examiner*—Andrew M. Falik
*Assistant Examiner*—Paul C. Lewis
*Attorney, Agent, or Firm*—Burns, Doane, Swecker & Mathis

[57] ABSTRACT

The present invention relates to an apparatus for sewing a label to a piece of fabric. The label is passed through a guiding channel until it is detected by a label sensor activating an air nozzle. The air stream ejected therefrom drives the label into a take-over station. The latter is constituted by two grippers arranged at a defined distance from each other and each consists of a lower and an upper gripper jaw clamping the edges of the label therebetween. Feed cylinders shift the grippers with the label held by them to the sewing site. The distance between the grippers can be varied with the aid of a threaded spindle assembly so that handling of labels of different sizes is possible.

13 Claims, 2 Drawing Sheets

Figure 1:
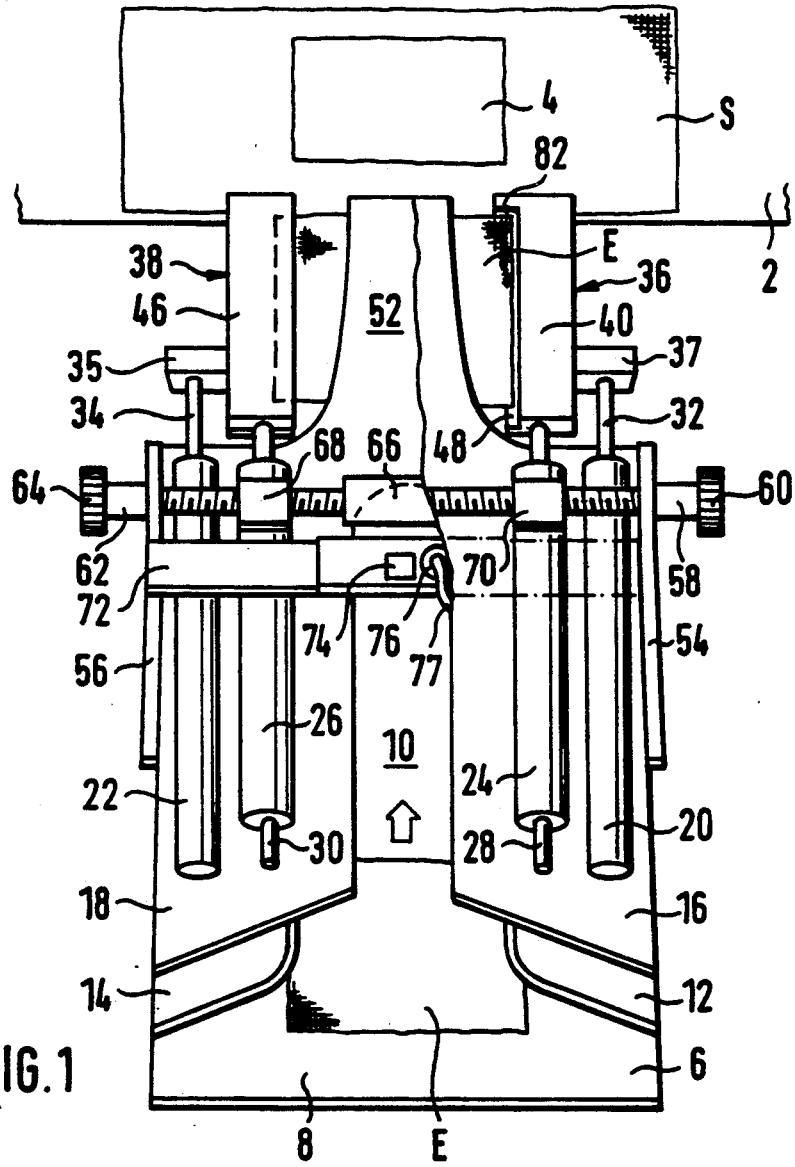

FIG. 3
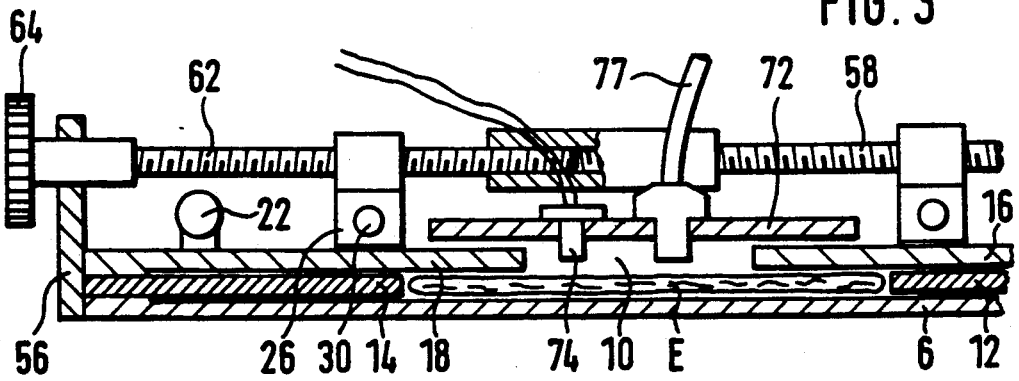
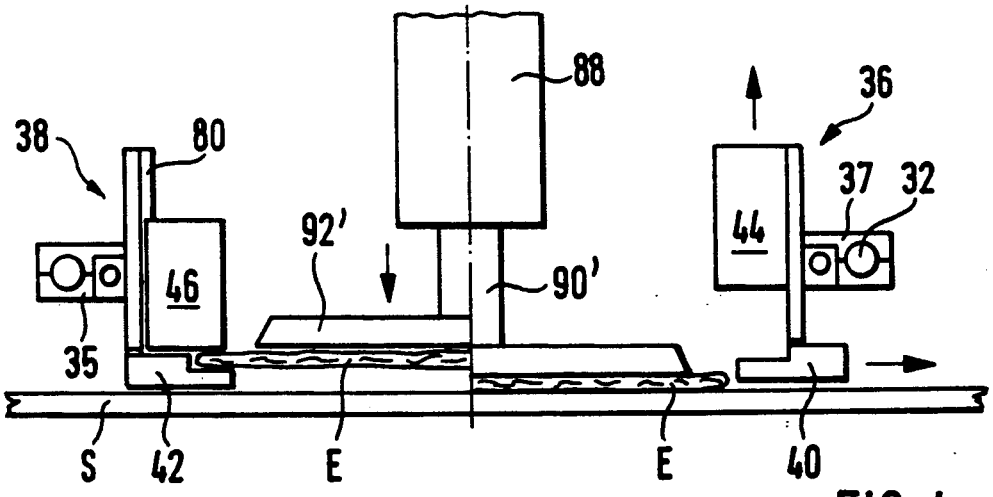
FIG. 4
FIG. 5
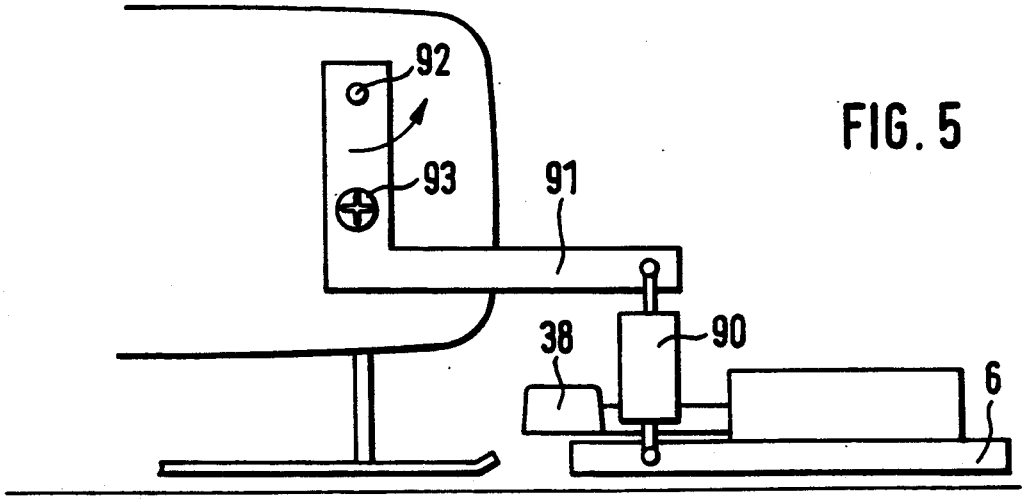

APPARATUS FOR FEEDING LABELS TO A SEWING SITE OF AN INDUSTRIAL SEWING MACHINE

The invention relates to an apparatus for feeding labels to a sewing site of an industrial sewing machine, comprising:

a) a carrier adapted to be positioned adjacent the sewing site; and b) a receiving means which is movable with respect to said carrier in a horizontal rectilinear manner and which takes up a label at a take-over station remote from the sewing site, then is moved to the sewing site where a pressing punch presses the label against a fabric located therebeneath, and thereafter is moved back to the take-over station in an empty condition.

Such apparatus are used in industrial sewing machines for sewing labels into garments, so that the separate labels are very rapidly positioned at the correct location and in the correct position.

The carrier has a guide means thereon for moving a label by hand to the take-over station. From there, the label is passed through a suitable feeding means into the receiving means. In the known apparatus, the receiving means consists of a template matched in size to the size of the label to be sewn in. The label is held in the template and moved to the sewing site by means of a pneumatic drive. At the sewing site, a punch is lowered from above onto the label held in the template, and when the label is pressed onto the fabric located on the sewing table, the template is moved again to the take-over station in an empty condition in order to take up a new label there.

The use of a template in inserting labels is advantageous in so far as the labels are safely guided and positioned. In case of a label of different size, the template may be replaced by another correspondingly dimensioned template. This replaceability permits the use of the apparatus for labels of different sizes.

However, it has turned out that changeover of the apparatus to another label size involves a relatively great expenditure in terms of time. For replacing the template, the apparatus and, consequently, also the associated sewing machine often must be stopped for a long time.

In the production of the templates, the exact size of the particular labels is naturally not yet known. Thus, one must make do by manufacturing a more or less coarsely graduated series of templates. In doing so, it may happen that a label has a size that is too small for the next greater template and too large for the next smaller template.

It is the object of the invention to provide an apparatus of the type indicated at the outset, which renders possible a more rapid changeover to other labels as regards size and shape and which has an improved positioning accuracy of the labels.

In an apparatus of the type mentioned, this object is met by the features:

c) the receiving means comprises two grippers disposed with an adjustable distance therebetween, transversely of the path of movement between sewing site and take-over station, and d) each gripper has a clamping means engaging an edge portion of the label.

By using adjustable grippers, exact matching of the gripper distance to the size of the labels to be sewn in can be achieved. The clamping means holds the label while the latter is being transported from the take-over station to the sewing site. Changeover is effected in simple manner by matching the distance between the opposed grippers to the size of the particular label.

For this purpose, the invention provides in a specific embodiment that the two grippers are coupled to a threaded spindle assembly having a righthand thread and a lefthand thread, so that they can be adjusted in synchronism and in opposite directions. Thus, an operator needs only one hand to rotate the threaded spindle assembly, and the grippers coupled thereto move—depending on the direction of rotation—towards or away from each other. Thus, the sewing person itself can make an adjustment to a new label width without the use of tools.

A particularly simple embodiment, which nevertheless permits secure retention of the label, provides:

a lower gripper jaw provided with a receiving surface, and an upper gripper jaw that is movable up and down and acts as a clamping member.

In the take-over station, the upper gripper jaw is first lifted off from the lower gripper jaw. When a label is then located on the receiving surfaces of the two lower gripper jaws, the upper gripper jaws are lowered so that the label is held at the edges. Upon movement of the grippers to the sewing site, the upper grippers are moved upwardly again after a pressing punch has urged the label against the fabric.

For avoiding a collision with the edges of the label upon retraction of the grippers, it is provided according to the invention that at least one of the lower gripper jaws is movable away from the other lower gripper jaw in about horizontal direction. Before the two grippers are retracted to the take-over station, the upper gripper jaws are thus lifted and the lower gripper jaws are moved horizontally (outwardly), so that the label is released completely.

Secure and exact movement of the gripper jaws is possible when the upper and the lower gripper jaws of each gripper are supported on a gripper support. This gripper support may be, e.g., a metal plate or a metal frame with corresponding guides for the gripper jaws.

According to a specific embodiment, the invention provides that the horizontal movement of the grippers is effected by horizontal pivoting. In a further specific embodiment the invention provides that the lower gripper jaw is horizontally displaceable.

Lifting and lowering of the upper gripper jaws takes place in conjunction with a gripper support, preferably in that both upper gripper jaws are vertically displaceable along a guide. The drive for the operational movements mentioned is effected preferably pneumatically.

In case of square or rectangular labels, the grippers or, respectively, the recesses thereof holding the label at the edges extend parallel to each other. With labels of different configuration, e.g. trapezoidal labels, safe holding of the labels is achieved in that the grippers are rotatable about a vertical axis. In this manner labels having non-parallel lateral edges can be safely held and conveyed as well.

According to a specific embodiment of the invention, it is provided that each lower gripper jaw, for forming the receiving surface, has in the top side of a block a marginal recess having a stop at the end facing the sewing site. When the label is moved from the take-over station towards the grippers, the lateral edges of the label finally move onto the receiving surfaces of the lower gripper jaws. Due to the stop, the movement of the label is stopped, so that the label is then correctly positioned.

A specific constructional development of the invention provides that the carrier is in the form of a base plate having formed thereon, by means of lateral sheet metal plates, an upwardly open guiding channel having a label placement location on the side facing away from the sewing site and adjoining the take-over station at the other side, that a label sensor and a driver air nozzle are arranged above the guiding channel upstream of the take-over station, and in that the grippers are aligned with the guiding channel at the take-over station. In this embodiment, the individual labels can be placed on the placement location either by mechanical means or by hand, in order to be subsequently shifted somewhat into the channel. When the label enters the region of the label sensor, which is e.g. a photo-diode and a photo-transistor sensing reflected or non-reflected light, respectively, a signal sensed thereby activates the driver air nozzle, and the air jet ejected from the air nozzle drives the label further towards the take-over station where the two grippers are located. The label moves onto the receiving surfaces of the grippers until it comes to a stand-still at the two stops of the two grippers. The upper gripper jaws are then lowered, and both grippers are moved to the sewing site.

For safely guiding the label on its path to the take-over station and for exactly positioning it there, it is provided according to the invention that a label supporting tongue extends from the guiding channel and projects across the label located in its end position in the receiving means.

For feeding the grippers between take-over station and sewing site, it is provided that a guide rail assembly and a feed assembly are supported on the carrier for each gripper, and in that an adjusting means extends transversely of the gripper feed direction and is in engagement with the guide rail assembly which, in turn, is coupled to the grippers. The adjusting means provides the possibility of adjusting the lateral position of the guide rail assembly and, thus, of the grippers coupled thereto.

The invention specifically provides that the guide rail assembly for each gripper has a guide rod coupled thereto, which is longitudinally displaceable in a sleeve supported on the carrier, and in that the sleeve is in engagement with a threaded spindle extending transversely across the carrier and being rotatably supported thereon. For changeover or resetting, it is merely necessary to rotate the threaded spindle, which has the consequence that the sleeve is moved in transverse direction and concomitantly moves the gripper connected thereto along therewith.

All controlledly moving parts are pneumatically driven according to the invention. Thus, feed cylinders may extend parallel to the guiding sleeves on the carrier, in which pistons may pneumatically reciprocate. The grippers or gripper supports are mounted to the outer ends of the pistons in such a manner that lateral adjustment is possible.

The width of the guiding channel for the labels is expediently adjusted in accordance with the distance between the grippers. When the grippers are adjusted to a larger label width, the guiding channel is adjusted together therewith in corresponding manner, so that safe guiding of the labels is ensured. The adjusting mechanism for the grippers preferably acts also on the lateral confines of the guiding channel so that the grippers or gripper guides and the lateral confines of the guiding channel each constitute a unit of movement.

Figure 2:
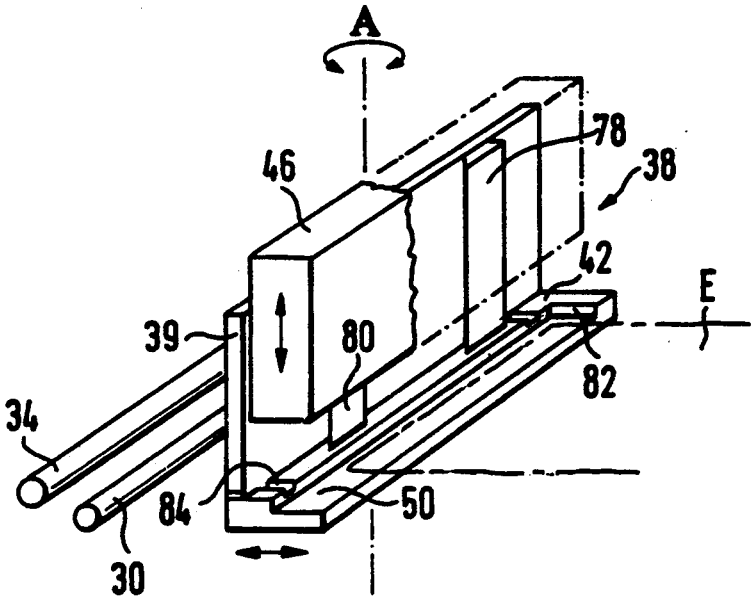

An embodiment of the invention will now be elucidated in more detail with reference to the drawings in which FIG. 1 shows a perspective front view from above onto an apparatus for feeding labels to a sewing site of an industrial sewing machine, FIG. 2 shows a perspective view of the gripper depicted only schematically on the left-hand side in FIG. 1 at the top, FIG. 3 shows a sectional view oriented transversely of the direction of movement of the grippers and illustrating the apparatus according to FIG. 1 at the location of the adjusting mechanism for the grippers, FIG. 4 shows a schematic view of the two grippers located at the sewing site, which are illustrated in different phases of movement, and FIG. 5 shows a schematic side view of the apparatus in a lifted condition.

At the top in FIG. 1, there is shown a part of a sewing table 2 of an industrial sewing machine. On the sewing table 2, there is disposed a fabric S. A label E is to be sewn to the fabric S at a sewing site 4.

As shown in FIG. 1, a label feeding apparatus, which is pivotably mounted and lockable to the sewing machine, serves for feeding a label E to the sewing site 4.

A base plate 6, serving as a carrier of the apparatus, is provided at its forward end with a label placement location 8 onto which a label E is placed. Label E is placed there e.g. by hand and is manually moved a short distance through a guiding channel 10 in the direction of the arrow shown.

According to FIG. 5, the base plate 6, with the aid of an angular lifting support 91, is mounted on the sewing machine so as to be pivotable about a swivel axis 92. The arrangement may be locked in the operating position by means of a fixing screw 93. At the free end of the angular lever 91 (there is provided a further, non-visible angular lever on the rear side of the sewing machine), there is located a pneumatic cylinder 90 which is pivotally connected to the base plate 6. After the angular lever 91 together with the arrangement mounted thereto is lowered, i.e. pivoted downwardly, the entire apparatus is lowered with the aid of the pneumatic cylinder 90 until grippers to be described in detail further below—with one gripper 38 being visible in FIG. 5—rest on the sewing material with a label to be sewn thereto.

Guiding channel 10 is formed by a right-hand lower lateral sheet metal plate 12, a left-hand lower lateral sheet metal plate 14, a right-hand upper sheet metal plate 16 and a left-hand upper sheet metal plate 18. The two upper plates 16 and 18 project further to the center of the base plate 6 than the lower lateral plates 12 and 14, but nevetherless leave an opening therebetween through which access to the label E is possible manually (or by a machine) in order to move the label in FIG. 1 upwardly through channel 10.

The two lower lateral plates 12 and 14 may be laterally adjustable for adjustment of the width of channel 10.

The apparatus depicted in FIG. 1 is largely symmetrical, so that features mentioned in the following elucidation for the one side apply analogously for the other side as well, unless express reference is made to the contrary.

A feed cylinder 20 in the form of a pneumatic cylinder is mounted on the right-hand upper plate 16, and beside the feed cylinder 20 a guiding sleeve 24 of plastic material is mounted on said plate 16. While the feed cylinder 20 is fixedly mounted on plate 16, the guiding sleeve 24 is laterally adjustable. A guide rod 28 extends longitudinally through the guiding sleeve 24 and has its upper end with respect to FIG. 1 coupled to a gripper 36. Laterally projecting from the gripper 36 is an arresting block 37 consisting of two parts between which the front end of a piston 32 is held which belongs to the feed cylinder 20.

On the right side in FIG. 1, a part of the, apparatus is broken away in order to make visible the parts located underneath.

The afore-described parts are provided on the left-hand side of FIG. 1 in corresponding manner. There are provided a feed cylinder 22 and a guiding sleeve 26 with a guide rod 30 guided therein. A piston 34 has its end fixed to a fixing block 35 of a lefthand gripper 38.

The right-hand gripper 36 consists of a lower gripper jaw 40 shown to the right in FIG. 1 and of an upper gripper jaw 44 which is not shown in FIG. 1. The left-hand gripper 38 has a lower gripper jaw 42, which is largely concealed on the left-hand side in FIG. 1, and an upper gripper jaw 46. The two upper gripper jaws can be shifted away from the lower gripper jaws by a vertical movement.

The two grippers 36 and 38 are symmetrical with respect to each other. FIG. 2 shows the construction of the left-hand gripper 38 in a perspective view. A gripper holding plate 39 horizontally supports the lower gripper jaw 42 by means of guide rails 84, while the upper gripper jaw 46 is supported by means of vertical guides 78, 80 so as to be vertically displaceable. Not shown in the drawings are pneumatic drive means for controlledly driving all moving parts. To the rear side of the gripper supporting plate 39 the end of piston 34 is mounted by means of the concealed fixing block 35. In said fixing block 35 the guide rod can be laterally displaced, depending on the position taken by the grippers with respect to the piston 34, as will still become clear from the further description.

In FIG. 2, a rotational axis A is outlined about which the entire gripper 38 is rotatable (this function is necessary for labels with non-parallel edges).

The lower gripper jaws 40, 42 each have a receiving surface 48, 50 formed by a recess in the top side of the respective gripper jaw. At the end facing the sewing site 4, there is provided a stop 82 (FIG. 2).

At the two side edges of the base plate 6 there are provided side plates 54 and 56 holding therebetween a transverse carrier 72 carrying a label sensor 74 and an air nozzle 76. The air nozzle is connected to a source of pressurized air via an air hose 77 which is shown only in fragmentary manner. When a label E passes below sensor 74, the latter generates a corrresponding signal. The label sensor 74 may be e.g. a photo-diode and a photo-transistor disposed beside the latter and receiving light reflected from the surface of the base plate 6. When there is a label E disposed below sensor 74, the photo-transistor does not receive light and issues a corresponding signal. This signal from label sensor 74 causes pressurized air to be supplied via hose 77 to the air nozzle 76, so that the nozzle 76 ejects an air stream driving the label E further in the direction towards the two grippers 36 and 38. In FIG. 1, the two grippers 36, 38 are disposed at a take-over station, i.e. a station where the grippers take over a label from the guiding channel 10.

As can be seen from FIG. 1, the two upper plates 16 and 18 are united in the region of the take-over station so as to form a label holding tongue 52 extending across a label held between grippers 36 and 38. The label moved upwardly in FIG. 1 by the air stream from the air nozzle 36 slides with its two lateral edges onto the supporting surfaces 48 and 50 of the two grippers 36 and 38 until this movement is stopped by the two stops 82. During this operation, the two upper gripper jaws 44 and 46 were disposed in their lifted position. After the label E has abutted on the stops 82, the two upper gripper jaws 44 and 46 are lowered so that they press the label onto the supporting surfaces 48 and 50. The label E is thereby firmly held between grippers 36 and 38. Lowering of the two upper gripper jaws 46 and 48 may take place a predetermined period of time after production of the signal of the label sensor 74.

Pressurized air is now applied to the two feed cylinders 20 and 22, so that the two pistons 32 and 34 move upwardly and rearwardly in FIG. 1 in order to move the two grippers 36 and 38 together with the label E held by them to the sewing site 4. In doing so, the two grippers 36 and 38 are safely guided by the two guide rods 28 and 30 in the guiding sleeves 24 and 36. The connection between the front ends of the guide rods 28 and 30 is shown just schematically in FIG. 1. In reality the guide rods and the pistons 32 and 34 are fixedly coupled to the respective gripper holding plate 39 (in FIG. 2).

Feeding of a label E to the take-over station between the grippers 36 and 38 shall be briefly elucidated again with reference to FIG. 3. FIG. 3 shows a section made approximately at the level of the air nozzle 76. As can be seen from FIG. 3, the guiding channel 10 is constituted by the base plate 6, the two lower lateral plates 12 and 14 and the two upper plates 16 and 18. As soon as the label E is detected by the sensor 74, a sensor signal causes pressurized air supplied via hose 77 to be ejected from the air nozzle 76 so that the label E is driven in the direction towards the take-over station.

An adjusting mechanism now is to be elucidated by way of FIGS. 1 and 3, by means of which the lateral spacing between the grippers 36 and 38 can be adjusted so that labels of different widths can be handled.

Threaded spindles 58 and 62 with righthand thread and lefthand thread, respectively, are supported in the two side plates 54 and 56, and the outwardly projecting ends thereof carry a turning knob 60 and 64, respectively. The threaded spindles 58 and 62 extend through threaded blocks 70 and 68 that are fixedly connected to the guiding sleeves 24 and 26, and the ends of the threaded spindles are held by a threaded bushing 66. Due to the fact that the two guiding sleeves 24 and 26 are supported on the plates 16 and 18 so as to be movable in lateral direction, i.e. transversely of their longitudinal direction, the lateral position of the guiding sleeve 24 can be changed by turning e.g. the knob 60 or 64, respectively; for, when the threaded spindle 58 rotates in the threaded block 70 having an internal thread meshing with the threaded spindle, while the threaded spindle 58 itself is in rotatable, but axially non-movable manner supported in the side plate 54, the guiding sleeve 24 is moved towards or away from the side plate 54. Together with the movement of the guiding sleeve 24, the associated guide rod 28 and the gripper 36 coupled thereto also move in lateral direction.

Due to the fact that the lead of threaded spindle 62, which is fixedly coupled to threaded spindle 58 via bushing 66, and of threaded block 68 is opposite to that of threaded spindle 58 and threaded block 70, the guiding sleeve 26 and the gripper 38 adjust in synchronism by the same amount in opposite directions, i.e. symmetrically, with respect to the center.

Although it is not shown in more detail in the drawings, the right-hand lower guide plate 12 is coupled to the guiding sleeve 24 so as to form a unit of movement. The same applies for the left-hand lower side plate 14 and the guiding sleeve 26. Thus, when the distance between the two grippers 36 and 38 is changed for adaptation to a specific label size, the width of the guiding channel 10 changes as well.

After movement of the grippers 36, 38 with the label E held by them to the sewing site 4, the apparatus is lowered until the grippers rest on the sewing material and the label is moved as close as possible to the sewing material, so that no distortion is caused when it is pressed on by the punch. The punch is then lowered, so that the label E is urged against the fabric S, and thereafter the two grippers 36, 38 are retracted again into the position shown in FIG. 1, so that the grippers returned to the take-over station can take up the next label.

The movement cycle at the sewing site will now be elucidated in more detail with reference to FIG. 4. FIG. 4 depicts on the left-hand side the condition shortly after arrival of the grippers at the sewing site, and on the right-hand side the condition shortly before the grippers leave the sewing site for returning to the take-over station.

It is apparent that the presentation according to FIG. 4 shows once the left-hand gripper and once the right-hand gripper. However, in reality both grippers move simultaneously and symmetrically with respect to each other, so that the operation described hereinafter for one gripper holds analogously for the other gripper as well.

Gripper 38 holds the left-hand edge of label E between the lower gripper jaw 42 and the upper gripper jaw 46. The label E itself still has a certain spacing from the fabric S located underneath, which is caused by the height of the lower gripper jaw 42 below the supporting surface.

A punch piston 90', carrying at its lower end a punch plate 92', is then lowered from a punch cylinder 88. The punch plate 92' comes to abut on the upper side of the label E between the two grippers 36 and 38.

In its lowermost position, shown on the right-hand side in FIG. 4, the punch plate 92 firmly presses the label E against the fabric S. The upper gripper jaw 44 is now pneumatically moved upwardly, and thereafter the lower gripper jaw 40 is moved to the right. The label E is thus free at the edges thereof, and the two grippers 36 and 38 may be retracted. The two lower gripper jaws 40 and 44 are again displaced towards each other so as to assume the position shown on the left-hand side in FIG. 4, in which they are ready to take up the next label. The two upper gripper jaws 44 and 46 still remain in the raised position.

We claim:

1. An apparatus, for feeding labels to a sewing site of an industrial sewing machine, comprising:

a carrier positioned adjacent the sewing site; and receiving means movable with respect to said carrier in a horizontal, rectilinear manner and which takes up a label at a take-over station remote from the sewing site, then is moved to the sewing site where a pressing punch presses the label against a fabric located therebeneath, and thereafter said receiving means is moved back to the take-over station in an empty condition;

the receiving means including two grippers having an adjustable distance therebetween, and disposed transversely of the path of movement between the sewing site and the take-over station;

each gripper having clamping means engaging an edge portion of the label;

wherein the two grippers are coupled to a threaded spindle assembly having a righthand thread and a lefthand thread, so that they can be adjusted in synchronism and in opposite directions.

2. An apparatus for feeding labels to a sewing site of an industrial sewing machine, comprising:

a carrier positioned adjacent the sewing site; and receiving means movable with respect to said carrier in a horizontal, rectilinear manner and which takes up a label at a take-over station remote from the sewing site, then is moved to the sewing site where a pressing punch presses the label against a fabric located therebeneath, and thereafter said receiving means is moved back to the take-over station in an empty condition;

the receiving means including two grippers having an adjustable distance therebetween, and disposed transversely of the path of movement between the sewing site and the take-over station;

each gripper having clamping means engaging an edge portion of the label;

wherein each gripper comprises;

a lower gripper jaw provided with a receiving surface, and an upper gripper jaw movable up and down and acting as a clamping member.

3. An apparatus according to claim 2, wherein both grippers are movable horizontally outwardly, and wherein the upper and the lower jaws of the grippers are supported on gripper supports.

4. An apparatus according to claim 2, wherein the grippers are horizontally pivotable.

5. An apparatus according to claim 2, wherein the lower gripper jaw is slidable in a horizontal direction.

6. An apparatus according to claim 2 wherein both upper gripper jaws are slidable in a vertical direction along a guide.

7. An apparatus, for feeding labels to a sewing site of an industrial sewing machine, comprising:

a carrier position adjacent the sewing site; and receiving means movable with respect to said carrier in a horizontal, rectilinear manner and which takes up a label at a take-over station remote from the sewing site, then is moved to the sewing site where a pressing punch presses the label against a fabric located therebeneath, and thereafter said receiving means is moved back to the take-over station in an empty condition;

the receiving means including two grippers having an adjustable distance therebetween, and disposed transversely of the path of movement between the sewing site and the take-over station;

each gripper having clamping means engaging an edge portion of the label;

wherein each of the grippers are rotatable about vertical axes.

8. An apparatus according to claim 2, wherein each lower gripper jaw, for forming the receiving surface is provided with a marginal recess having a stop at the end of the recess facing the sewing site.

9. An apparatus for feeding labels to a sewing site of an industrial sewing machine, comprising:

a carrier positioned adjacent the sewing site; and receiving means movable with respect to said carrier in a horizontal, rectilinear manner and which takes up a label at a take-over station remote from the sewing site, then is moved to the sewing site where a pressing punch presses the label against a fabric located there-beneath, and thereafter said receiving means is moved back to the take-over station in an empty condition;

the receiving means including two grippers having an adjustable distance therebetween, and disposed transversely of the path of movement between the sewing site and the take-over station;

each gripper having a clamping means engaging an edge portion of the label;

the carrier is in the form of a base plate having formed thereon, by means of lateral plates, an upwardly open guiding channel having a label placement location on the side facing away from the sewing site and adjoining the take-over station on the other side, a label sensor and a driver air nozzle being disposed above the guiding channel upstream of the take-over station, and wherein the grippers are aligned with the guiding channel at the taken-over station.

10. An apparatus according to claim 9, wherein a label supporting tongue extends from the guiding channel and projects across the label located in the receiving means.

11. An apparatus according to claim 9, wherein a guide rail assembly and a feed assembly are supported on the carrier for each gripper, and wherein an adjusting means extends transversely on the gripper feed direction and is in engagement with the guide rail assembly which in turn is coupled to the gripper.

12. An apparatus according to claim 11, wherein the guide rail assembly for each gripper has a guide rod coupled thereto which is longitudinally displaceable in a sleeve supported on the carrier, and wherein the sleeve is in engagement with a threaded spindle extending transversely across the carrier and being rotatably supported thereon.

13. An apparatus according to claim 9, wherein the width of the guiding channel is adjustable in according with the distance between the grippers.

* * * * *